US005336149A

United States Patent [19]

Wang

[11] Patent Number: 5,336,149

[45] Date of Patent: Aug. 9, 1994

[54] ABDOMINAL AND HIP EXERCISING APPARATUS

[75] Inventor: Leao Wang, Taichung Hsien, Taiwan

[73] Assignee: Greenmaster Industrial Corp., Taichung Hsien, Taiwan

[21] Appl. No.: 10,172

[22] Filed: Jan. 28, 1993

[51] Int. Cl.[5] ..... A63B 21/062

[52] U.S. Cl. ..... 482/100; 482/137

[58] Field of Search ..... 482/97–103, 482/133–139

[56] References Cited

U.S. PATENT DOCUMENTS

| | | | |
|---|---|---|---|
| 4,247,098 | 1/1981 | Brentham | 482/139 X |
| 4,296,924 | 10/1981 | Anzaldua et al | 482/139 |
| 4,387,893 | 6/1983 | Baldwin | 482/100 X |
| 4,405,128 | 9/1983 | McLaughlin et al. | 482/97 |
| 4,462,252 | 7/1984 | Smidt et al. | 482/137 X |
| 4,541,628 | 9/1985 | Parviainen | 482/137 |
| 4,627,619 | 12/1986 | Rockwell et al. | 482/137 |
| 4,666,151 | 5/1987 | Chillier | 482/99 X |
| 4,711,448 | 12/1987 | Minkow et al. | 482/137 X |
| 4,725,056 | 2/1988 | Rehrl et al. | 482/139 X |
| 5,007,634 | 4/1991 | Jones | 482/137 X |
| 5,039,089 | 8/1991 | Lapceuic | 482/97 |
| 5,058,888 | 10/1991 | Walker et al. | 482/138 X |
| 5,074,551 | 12/1991 | Olschansky et al. | 482/137 |
| 5,094,449 | 3/1992 | Stearns | 482/100 X |
| 5,100,128 | 3/1992 | Mabry et al. | 482/137 X |
| 5,104,121 | 4/1992 | Webb | 482/100 X |

FOREIGN PATENT DOCUMENTS

| | | | |
|---|---|---|---|
| 289896 | 2/1966 | Australia | 482/137 |

*Primary Examiner*—Robert Bahr
*Attorney, Agent, or Firm*—Bacon & Thomas

[57] ABSTRACT

A vertical type abdominal and hip exercising apparatus including two swivel frames bilaterally and revolvably fastened to two angle bars on two opposite sides of a back rest being fastened to a bevel frame above a machine base and turned by the player's chest or legs to lift weights through traction cables and a pulley block for trunk bending or leg pressing exercises. The swivel frames are linked for synchronous movement. Each swivel frame has two position-adjustable actuating members for turning with the chest or the leg in lifting the weights.

6 Claims, 7 Drawing Sheets

ABDOMINAL AND HIP EXERCISING APPARATUS

BACKGROUND OF THE INVENTION

The present invention relates to an abdominal and hip exercising apparatus, and more particularly the present invention relates to a vertical type abdominal and hip exercising apparatus.

Various exercising apparatus have been proposed for different purposes, and have appeared on the market. A normal universal gym generally has an abdominal board for exercising the muscles of the abdominal. When in use, the player should lie on the abdominal board and then alternately bend the trunk. This exercising method needs much effort to perform, and therefore it is not suitable for fat or aged persons.

FIG. 1. 1 illustrates an adbominal exercising apparatus from CYBEN U.S.A. called ABNOMINAL, which allows the player to sit on a chair and then bend the trunk forwards in lifting weights. The load of the weights can be adjusted according to individual physical conditions. However, this structure of abnominal exercising apparatus needs much installation space, and allows only a limited space for bending the trunk. CYBEN U.S.A. also produces another exercising apparatus called MULTI-HIP for exercising the muscles of the hips. However, this apparatus can only be used for exercising the muscles of the hips, and therefore it is not economical.

SUMMARY OF THE INVENTION

The present invention has been accomplished under the aforesaid circumstances. It is therefore an object of the present invention to provide an exercising apparatus which allows the player to exercise the muscles of the abdominal and hips when standing up. It is another object of the present invention to provide a vertical type abdominal and hip exercising apparatus which is suitable for people of all ages. It is still another object of the present invention to provide a vertical type abdominal and hip exercising apparatus which can be combined with other exercising apparatus to form a universal gym. It is still another object of the present invention to provide a vertical type abdominal and hip exercising apparatus which allows other exercising apparatus to use its traction cables and weights.

BRIEF DESCRIPTION OF THE DRAWINGS

FIG. 3A is an enlarged view of the swivel frame, particularly showing the first branch and extension axle;

FIG. 3B is an enlarged view of the actuating member, particularly showing the knob and barrel assembly;

FIG. 9 is another side view showing the exercising apparatus of FIG. 3 used to exercise the muscles of the hips; and FIG. 10 illustrates the exercising apparatus of FIG. 3 combined a different exercising apparatus to form a multipurpose exercising apparatus.

DETAILED DESCRIPTION OF THE PREFERRED EMBODIMENT

Figure 1:
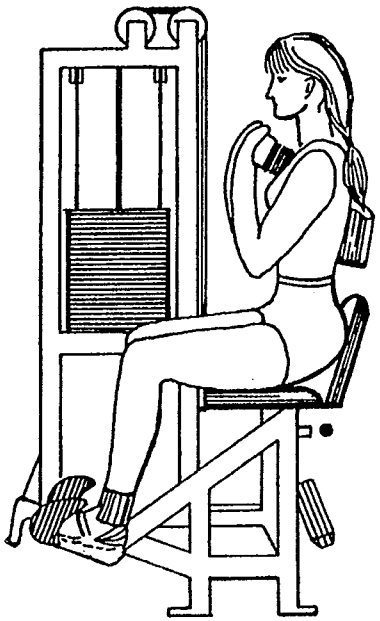
FIG. 1 PRIOR ART
FIG. 1 is a side view showing an ABDOMINAL exercising apparatus from CYBEN operated by a player.
Figure 2:
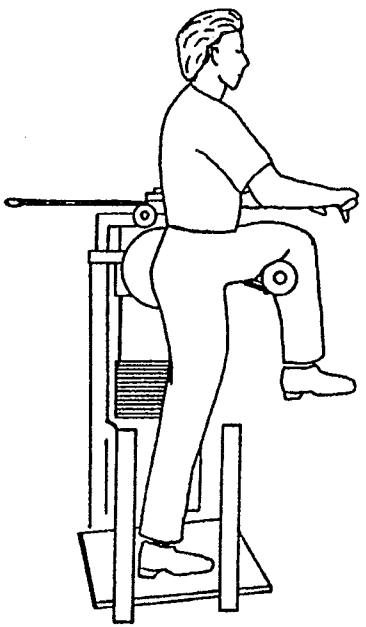
FIG. 2 PRIOR ART
FIG. 2 is a side view showing a MULTI-HIP exercising apparatus from CYBEN operated by a player.
Figure 3:
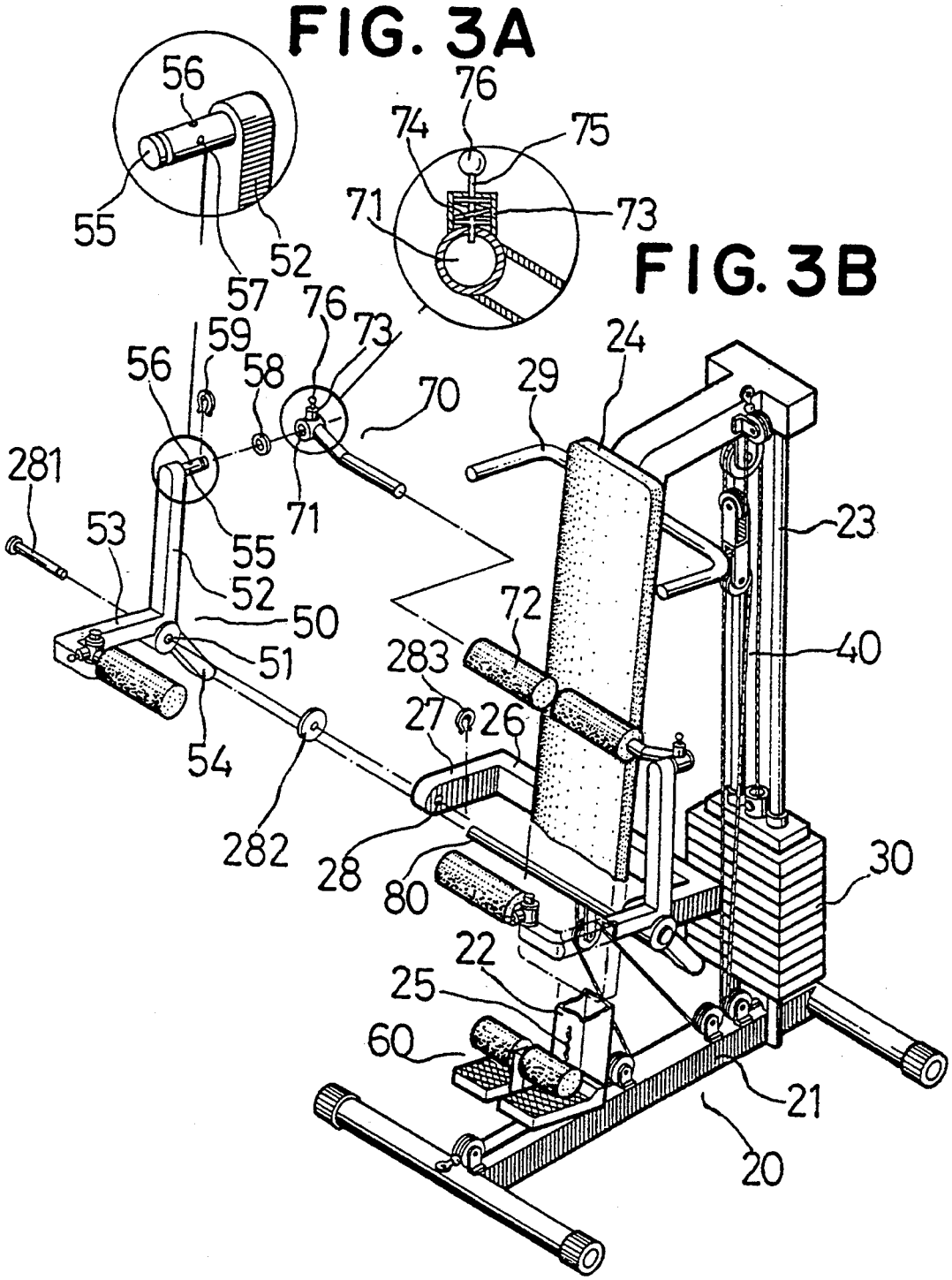
FIG. 3 is a partical exploded view of a vertical type abdominal and hip exercising apparatus according to the present invention.
Figure 4:
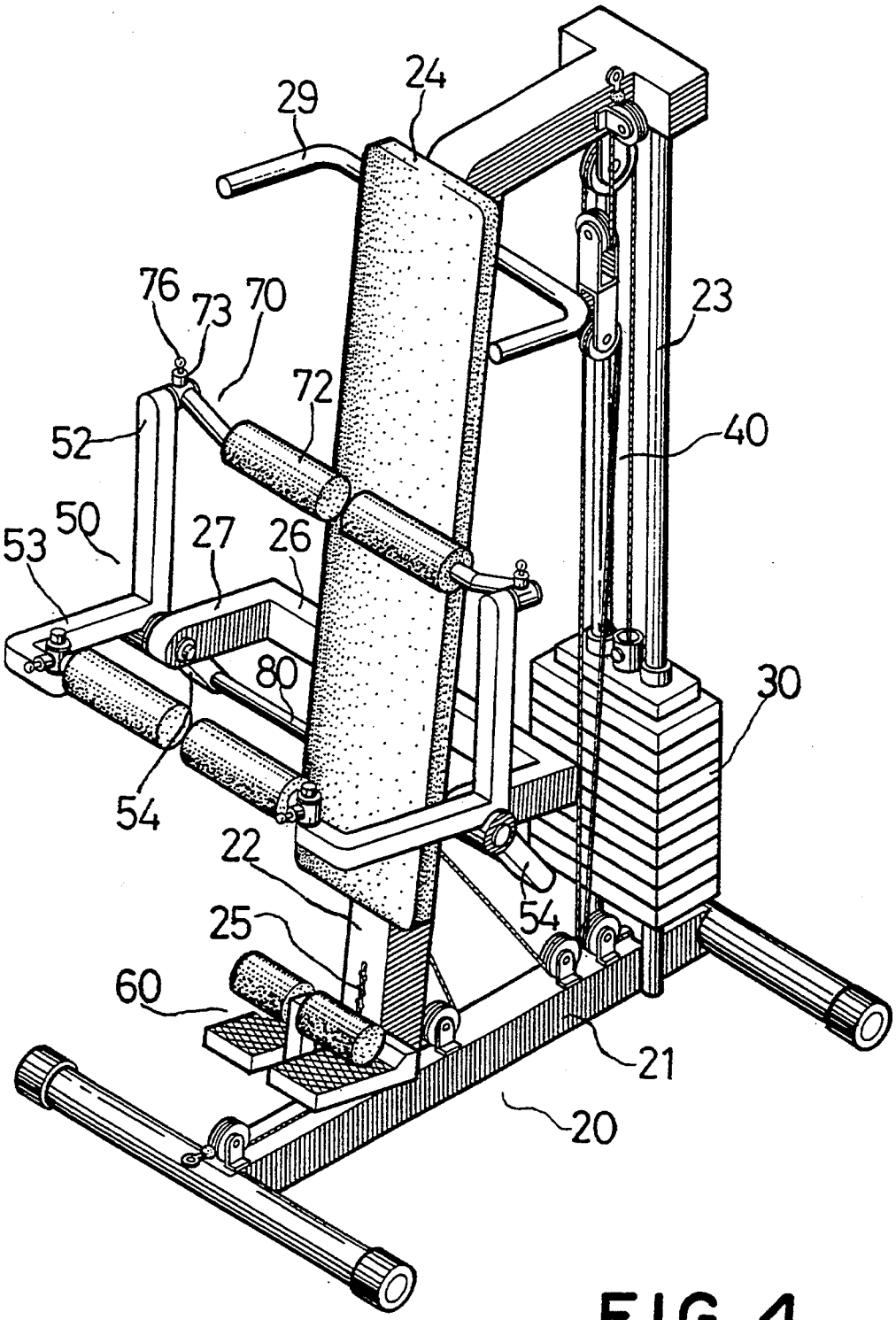
FIG. 4 is a perspective view of the exercising apparatus of FIG. 3.

Referring to FIGS. 3 and 4, a vertical type abdominal and hip exercising apparatus in accordance with the present invention is generally comprised of frame body 20, weights 30, traction cables 40, swivel frames 50, elevation-adjustable foot plate assembly 60, actuating members 70, and link 80.

Frame body 20 comprises an I-shaped base 21, a bevel frame 22 obliquely raised upwards and backwards from the I-shaped base 21 near its front end, two parallel guide rods 23 vertically welded to the rear end of the I-shaped base 21 to hold a set of weights 30, a soft back rest 24 mounted on the bevel frame 22 at the front. The bevel frame 22 has a serrated longitudinal slot 25 at the front, which receives a foot plate assembly 60. The foot plate assembly 60 is fastened to the serrated longitudinal slot 25 and positioned at the desired elevation by means of the control of a pull knob 61 (See FIG. 5). Two angle bars 26 are bilaterally and symmetrically fastened to the middle part of the bevel frame 22. Each angle bar 26 has one end connected to the bevel frame 22 and an opposite end 27 turned toward the front in the horizontal direction. The end 27 has a through hole 28, to which a respective swivel frame 50 is fastened by a pin 281, a washer 282 and a clamp 283. The swivel frame 50 comprises a center through hole 51, through which a respective pin 281 inserts, and three branches, namely, the first branch 52, the second branch 53, and the third branch 54 radially and equiangularlly spaced from one another. The first and second branches 52,53 each have a perpendicular extension axle 55 respectively extended backwards or upwards. The extension axle 55 has two locating holes 56,57 for mounting a respective actuating member 70 by a washer 58 and a clamp 59. The actuating member 70 is covered with a soft covering 72, having a perpendicular barrel 71 at one end sleeved on the extension axle 55 on the first or second branch 52 or 53. The barrel 71 comprises an outside chamber 73, a spring 74 received inside the chamber 73, a crossed pin 75 retained by the spring 74 in the chamber. The crossed pin 75 has one end extended out of the chamber 73 through a hole (not shown) thereon and coupled with a knob 76, and one opposite end projected into the barrel 71 and inserted into either locating hole 56 or 57. By pulling the knob 76, the crossed pin 75 can be removed from one locating hole 56 or 57 and then inserted into the other locating hole 57 or 56. The third branch 54 of one swivel frame 50 is connected to the third branch 54 of the other by a link 80. Therefore, the turning one swivel frame 50 causes the other to move in synchronism therewith.

Figure 5:
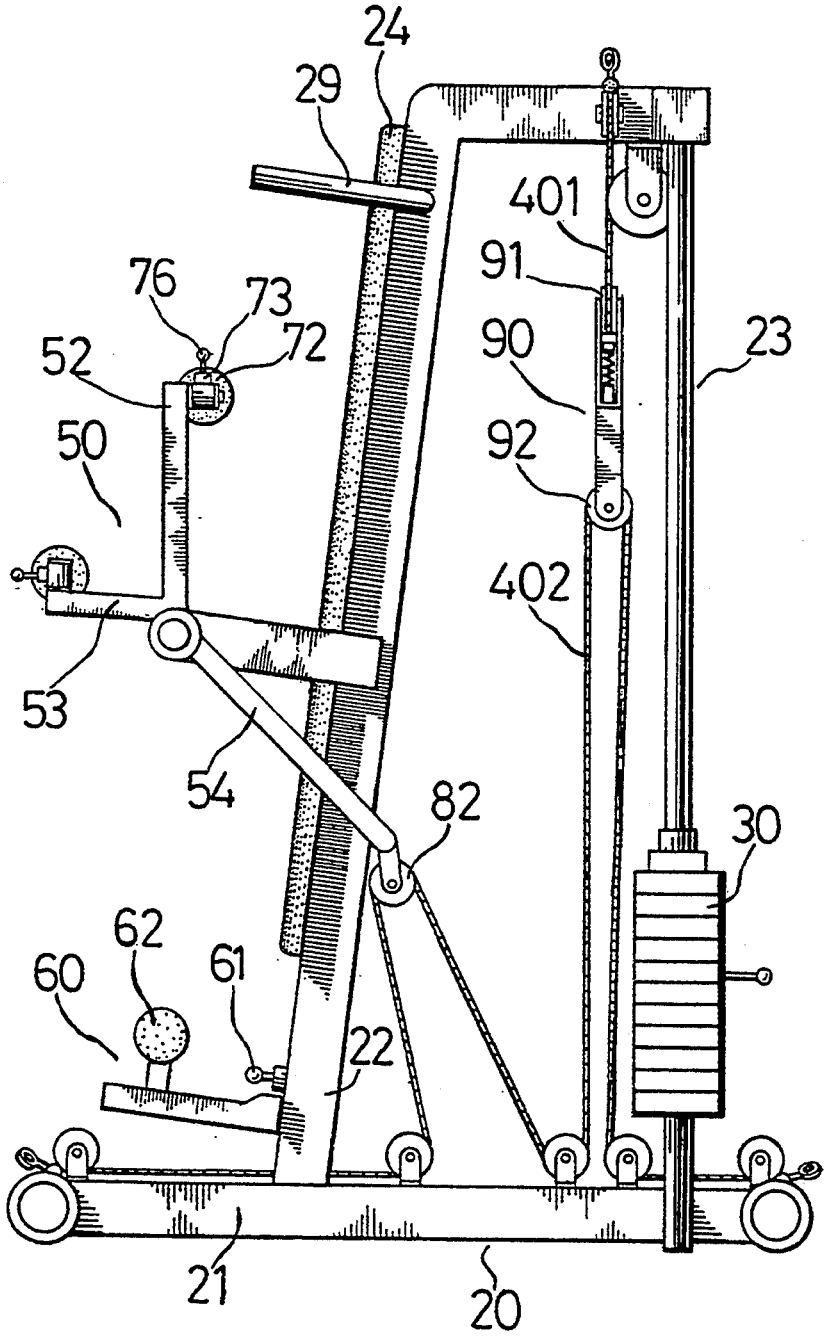
FIG. 5 is a side view of the exercising apparatus of FIG. 3.

Referring to FIG. 5, two traction cables 40 are used for traction. The first traction cable 401 has one end coupled to the weights 30 on the guide rods 23, and an opposite end wound around a first pulley 91 of a pulley block 90 and then fixed to a locating means or coupled to an external exercising device. The second traction cable 402 has one end fixed to the rear end of the I-shaped base 21, and an opposite end wound around a second pulley 92 of the pulley block 90 and then wound through a locating pulley 82 on the link 80 and then fixed to the front end of the I-shaped base 21. Turning the link 80 forwardly causes the traction cables 40 to drag the weights 30 upwards along the guide rods 23 (the guide rods 23 are respectively inserted through holes on the weights 30 so that the weights 30 can be lifted and lowered on the guide rods 23 alternatively).

Figure 6:
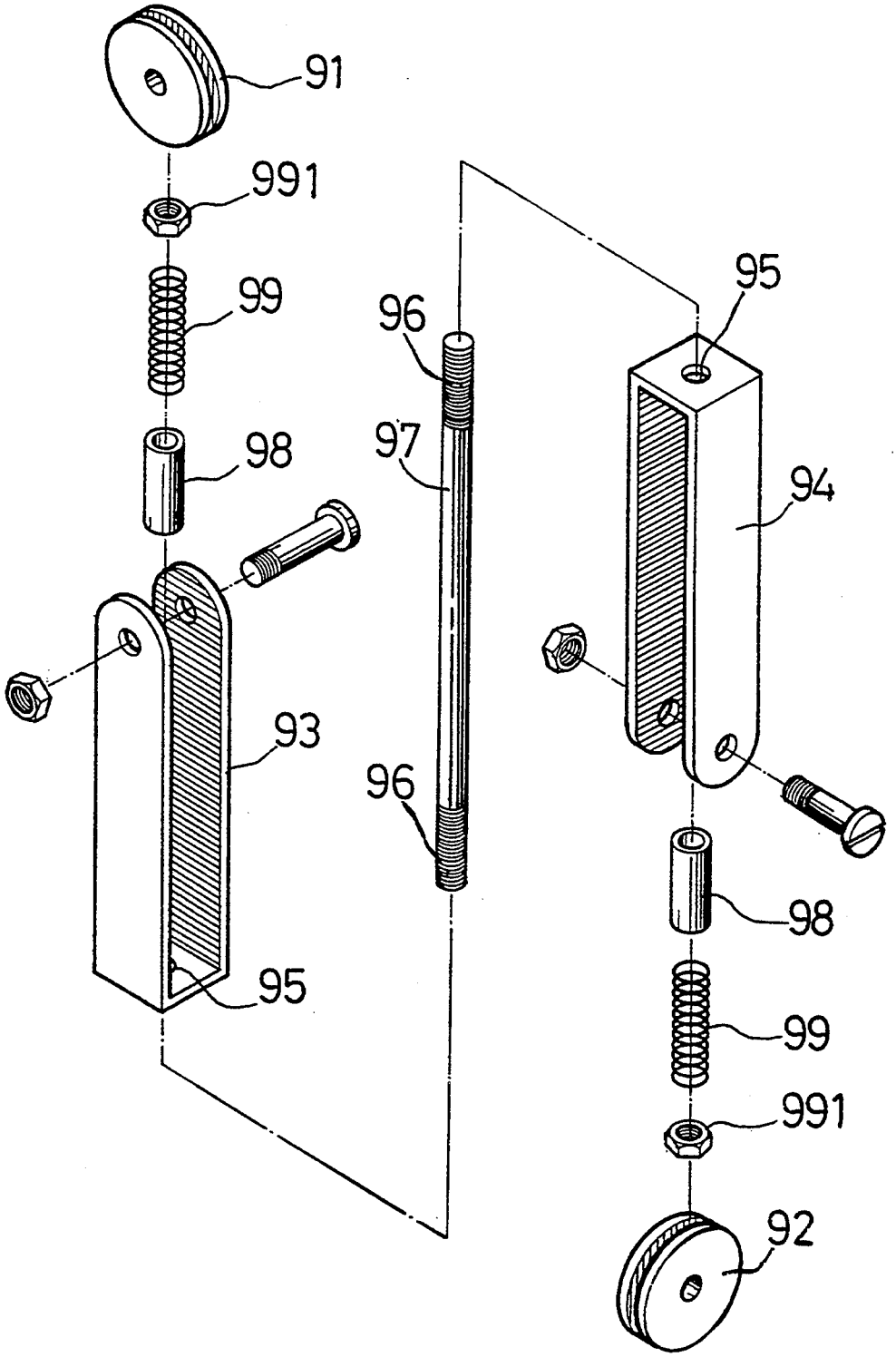
FIG. 6 is an exploded view of a pulley block according to the present invention.

Referring to FIG. 6, the aforesaid pulley block 90 comprises two U-shaped frames 93,94 longitudinally and movably connected in reversed directions by a straight rod 97. The straight rod 97 has two threaded opposite ends 96 respectively inserted through a respective center through hole 95 on either U-shaped frame 93 or 94, a respective bushing 98, and a respective spring coil 99, and then coupled with a respective nut 991. Therefore, the U-shaped frames 93,94 can be respectively pulled apart from each other along the straight rod 97 and limited by the respective nut 991. When the external pull force is removed, the two opposite spring coils 99 automatically move the U-shaped frames 93,94 toward each other.

Figure 8:
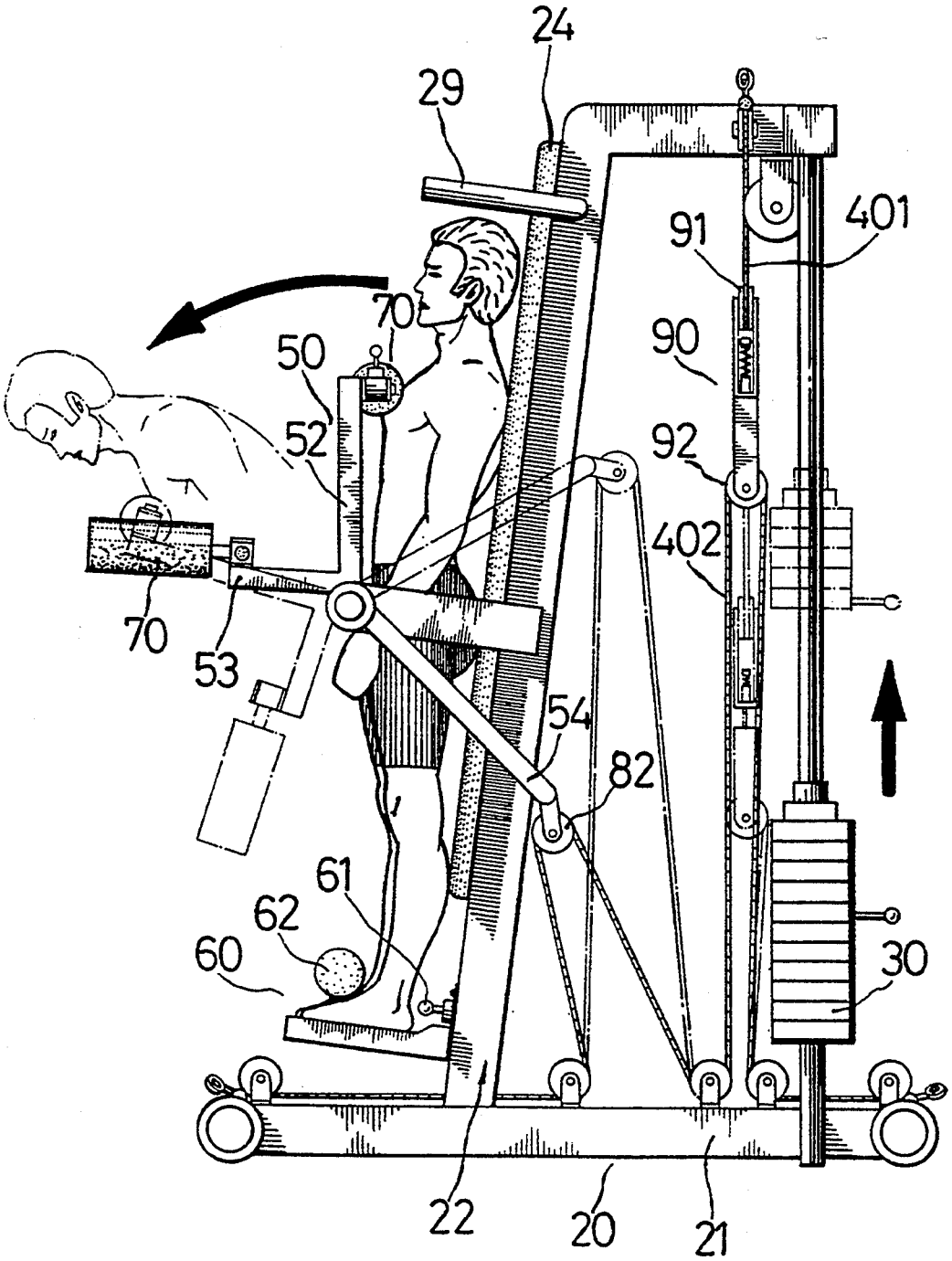
FIG. 8 is a side view showing the exercising apparatus of FIG. 3 used to exercise the muscles of the abdomen.

Because of the arrangement of the spring coils 99, the swivel frames 50 can be turned through an "idle stroke" to stretch the traction cables 40 without lifting the weights 30. The actuating member 70 on the first branch 52 of each swivel frame 50 is for exercising "trunk bending forwards" (see FIG. 8). Before exercising "trunk bending forwards, the player stands on the foot plate assembly 60 with the back supported on the back rest 24 and the chest stopped against the soft covering 72 of the actuating member 70 on the first branch 52 of each swivel frame 50. The aforesaid "idle stroke" provides a flexibility which allows the pitch between the back rest 24 and the first branch 52 of either swivel frame 50 to be adjusted according to the player's bustline. The actuating member 70 on the second branch 53 of each swivel frame 50 is for exercising "leg press" (see FIG. 9). Before exercising "leg press", the player stands with one leg on the foot plate assembly 60 and with the other leg hung over the actuating member 70 of the second branch 53 of the corresponding swivel frame 50. The flexibility of the aforesaid "idle stroke" also allows the actuating member 70 of the second branch 53 to be lowered to a lower elevation for hanging the leg without causing the traction cables 40 to lift the weights 30. After each use, the spring coils 99 cause the pulley block to pull the swivel frames 50 back to their former positions via the traction cables 40. By turning the nut 991 forwards or backwards on either threaded end 96 of the straight rod 97, the tension of the traction cables 40 is adjusted.

Figure 7A:
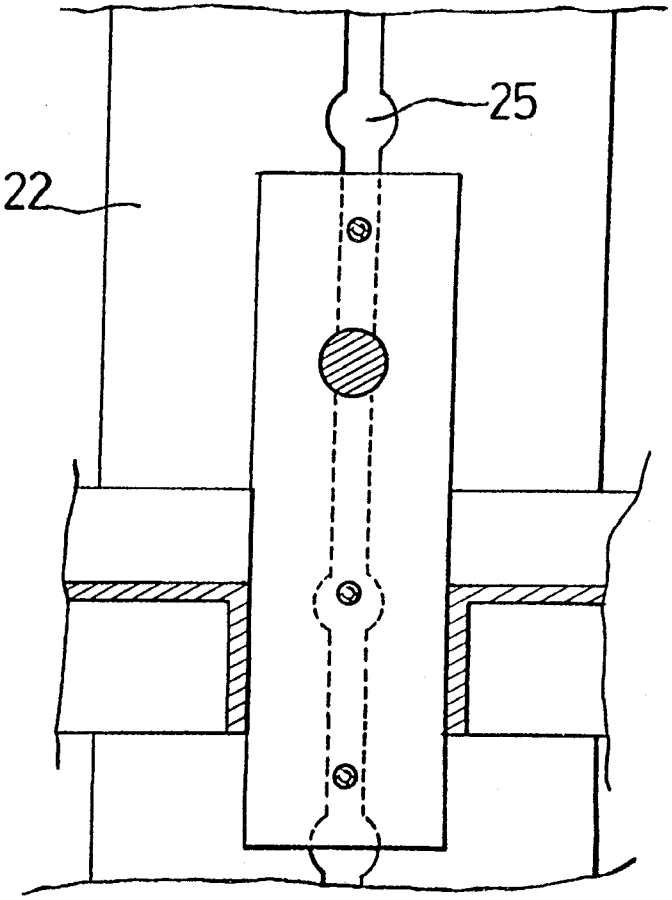
FIG. 7A is a view taken along the line A—A of FIG. 7.
Figure 7:
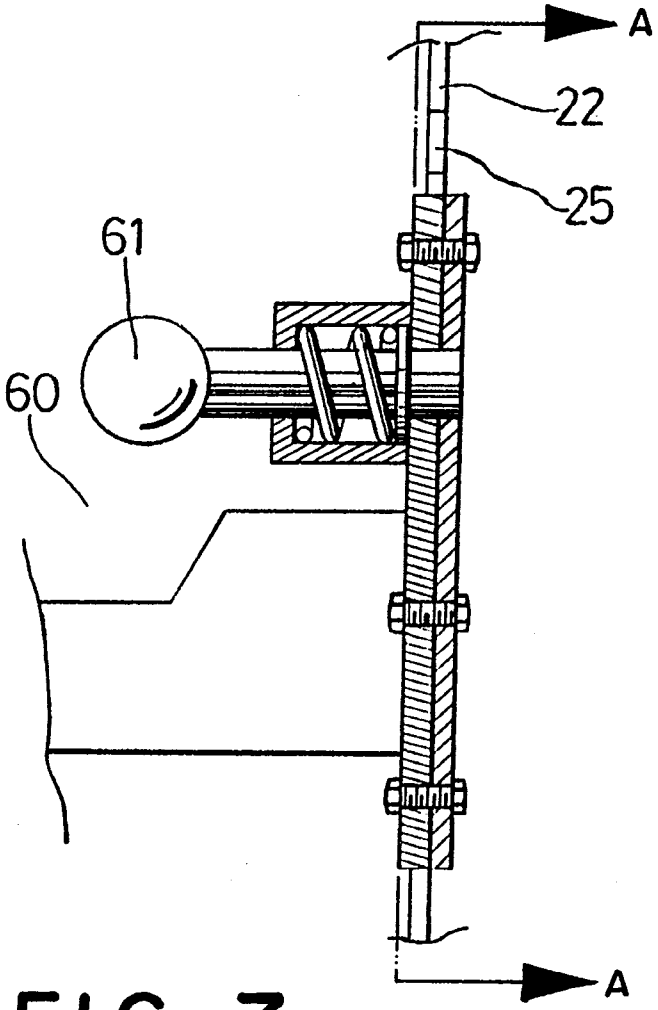
FIG. 7 is a sectional view of the foot plate assembly of the exercising apparatus of FIG. 3.

Referring to FIG. 7, the elevation of the foot plate assembly 60 can be adjusted along the serrated slot 25 by pulling the pull knob 61 outwards. The foot plate assembly 60 further comprises two horizontal stop bars 62 to stop the legs in place. In order to prevent from hurting the legs, the stop bars 62 are respectively covered with a soft covering.

Further, using the angle bars 26 to hold the swivel frames 50 permits the pivot point of each swivel frame 50 to be disposed closer to the corresponding hip joint of the player so that the actuating member 70 on the first branch 52 can be smoothly reciprocated by the player's chest.

As indicated, the crossed pin 75 can be removed from one locating hole 56 or 57 on the respective extension axle 55 and then inserted into the other 57 or 56, and therefore the position of each actuating member 70 on the respective brach of the respective swivel frame 50 is adjusted. By adjusting the positions of the actuating members 70 on the first and second branches 52,53 of the two swivel frames 50, the exercising apparatus is adjusted for exercising "trunck bending forwards" (see FIG. 8) or "leg press" (see FIG. 9).

Further, there are handlebars 29 bilaterally fastened to the bevel frame 22 at the top for the holding of the hands when exercising "leg press".

Referring to FIG. 10, the vertical type abdominal and hip exercising apparatus may be combined with another exercising apparatus to form a multipurpose exercising apparatus for permitting the traction cables and the weights of the vertical type abdominal and hip exercising apparatus to be commonly used for traction.

While only the preferred embodiment of the present invention has been shown and described, it will be understood that various changes and modifications can be made without departing from the scope of the invention.

What is claimed is:

1. An abdominal and hip exercising apparatus comprising:

a) a machine base;

b) a bevel frame on the machine base;

c) a back rest fastened to the bevel frame;

d) an angle bar on each of two opposite sides of the back rest;

e) a pair of swivel frames, and means for pivotally connecting each swivel frame to an angle bar;

f) each swivel frame including a first branch, a second branch and a third branch, the three branches being radially equiangularly spaced from each other, the first branch including an extension axle provided with two locating holes and an actuating member for fastening to either of the locating holes for exercising the abdominal region, the second branch including an extension axle provided with two locating holes and an actuating member fastenable to either of the locating holes for exercising the hip and leg region, the third branch of one swivel frame being linked to the third branch of the other swivel frame for synchronous movement; and g) a weight means, a pulley block, and a traction cable means connecting the weight means through the pulley block to the swivel frames.

2. The vertical type abdominal and hip exercising apparatus according to claim 1, wherein each actuating member is covered with a respective soft covering, having a perpendicular barrel at one end sleeved on the corresponding extension axle, said barrel comprising a chamber on the outside, a spring received inside said chamber, and a crossed pin retained by said spring in said chamber, said crossed pin having one end extended out of siad chamber through a hole thereon and coupled with a knob, and one opposite end projected into the corresponding barrel and inserted into either locating hole on the corresponding extension axle.

3. The vertical type abdominal and hip exercising apparatus according to claim 1, wherein said pulley block comprises two U-shaped frames longitudinally and movably connected in reversed directions by a straight rod, said straight rod having two threaded opposite ends respectively inserted through a respective center through hole on either U-shaped frame, a respective bushing, and a respective spring coil, and then fastened with a respective nut.

4. The vertical type abdominal and hip exercising apparatus according to claim 3, wherein said U-shaped frames can be respectively pulled apart from each other along said straight rod for permitting said swivel frames to be turned through a fixed angle without lifting said weights, so that the pitch between the back rest and the actuating member on the first branch of either swivel frame or the elevation of the actuating member on the second branch of either swivel frame can be adjusted according to the player's body size.

5. The vertical type abdominal and hip exercising apparatus according to claim 2, wherein the crossed pin of either actuating member can be removed from one locating hole on the corresponding extension axle by pulling the corresponding knob and then inserted into the other locating hole on the same extension axle for permitting the actuating member on the first or second branch of either swivel to be positioned in the operative position for bending the trunk or pressing the leg.

6. The vertical type abdominal and hip exercising apparatus according to claim 1, wherein said bevel frame comprises a pair of handle bars bilaterally disposed at the top for the holding of the hands as the player is playing the exercising apparatus.

* * * * *